US009043058B1

(12) United States Patent
Camp et al.

(10) Patent No.: US 9,043,058 B1
(45) Date of Patent: May 26, 2015

(54) SYSTEMS AND METHODS FOR FACILITATING SHIFT CHANGES IN MARINE PROPULSION DEVICES

(71) Applicant: Brunswick Corporation, Lake Forest, IL (US)

(72) Inventors: David G. Camp, Fond du Lac, WI (US); Thomas S. Kirchhoff, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/144,135

(22) Filed: Dec. 30, 2013

Related U.S. Application Data

(60) Provisional application No. 61/782,364, filed on Mar. 14, 2013.

(51) Int. Cl.
*B63H 23/02* (2006.01)

(52) U.S. Cl.
CPC ..... *B63H 23/02* (2013.01)

(58) Field of Classification Search
USPC ..... 701/21
See application file for complete search history.

(56) References Cited

U.S. PATENT DOCUMENTS

| | | | | |
|---|---|---|---|---|
| 4,257,506 | A | 3/1981 | Bankstahl | |
| 4,753,618 | A | 6/1988 | Entringer | |
| 4,843,914 | A | 7/1989 | Koike | |
| 4,843,915 | A | 7/1989 | Sugimura et al. | |
| 4,903,662 | A | 2/1990 | Hirukawa et al. | |
| 4,952,181 | A | 8/1990 | Entringer et al. | |
| 4,986,776 | A | 1/1991 | Hensel et al. | |
| 5,050,461 | A | 9/1991 | Onoue et al. | |
| 5,827,150 | A | 10/1998 | Mukumoto | |
| 5,853,306 | A | 12/1998 | Worth et al. | |
| 6,273,771 | B1 | 8/2001 | Buckley et al. | |
| 6,544,083 | B1 | 4/2003 | Sawyer et al. | |
| 6,692,320 | B1 | 2/2004 | Sawyer | |
| 6,929,518 | B1 | 8/2005 | Sawyer et al. | |
| 6,942,530 | B1 | 9/2005 | Hall et al. | |
| 7,214,164 | B2 | 5/2007 | Shomura et al. | |
| 7,472,010 | B2 * | 12/2008 | Thomson et al. | 701/51 |
| 7,549,900 | B2 * | 6/2009 | Kinoshita et al. | 440/1 |
| 8,165,736 | B2 * | 4/2012 | Gai et al. | 701/21 |
| 8,182,396 | B2 * | 5/2012 | Martin et al. | 477/110 |
| 8,446,265 | B2 * | 5/2013 | Golomb | 340/425.5 |
| 8,454,402 | B1 * | 6/2013 | Arbuckle et al. | 440/86 |
| 2011/0195816 | A1 * | 8/2011 | Martin et al. | 477/115 |

* cited by examiner

*Primary Examiner* — Thomas Tarcza
*Assistant Examiner* — Alex C Dunn
(74) *Attorney, Agent, or Firm* — Andrus Intellectual Property Law, LLP

(57) ABSTRACT

Methods and systems are for facilitating shift changes in a marine propulsion device having an internal combustion engine and a shift linkage that operatively connects a shift control lever to a transmission for effecting shift changes amongst a reverse gear, a neutral gear and a forward gear. A position sensor senses position of the shift linkage. A speed sensor senses speed of the engine. A control circuit compares the speed of the engine to a stored engine speed and modifies, based upon the position of the shift linkage when the speed of the engine reaches the stored engine speed, a neutral state threshold that determines when the control circuit ceases reducing the speed of the engine to facilitate a shift change.

20 Claims, 10 Drawing Sheets

SYSTEMS AND METHODS FOR FACILITATING SHIFT CHANGES IN MARINE PROPULSION DEVICES

CROSS-REFERENCE TO RELATED APPLICATION

The present application claims the benefit of and priority to U.S. Provisional Patent Application Ser. No. 61/782,364, filed Mar. 14, 2013, which is incorporated herein by reference in entirety.

FIELD

The present disclosure relates to marine propulsion devices, and more particularly to systems and methods for facilitating shift changes in marine propulsion devices.

BACKGROUND

The following US Patents and Applications provide background information and are incorporated herein by reference in entirety.

U.S. Pat. No. 4,753,618 discloses a shift cable assembly for a marine drive that includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position and the arm includes an improved mounting for retaining the spring in its proper location on the arm.

U.S. Pat. No. 4,952,181 discloses a shift cable assembly for a marine drive having a clutch and gear assembly, including a remote control for selectively positioning the clutch and gear assembly into forward, neutral and reverse, a control cable connecting the remote control to a shift lever pivotally mounted on a shift plate, a drive cable connecting the shift lever on the shift plate to the clutch and gear assembly, and a spring guide assembly with compression springs biased to a loaded condition by movement of the remote control from neutral to forward and also biased to a loaded condition by movement of the remote control from neutral to reverse. The bias minimizes chatter of the clutch and gear assembly upon shifting into gear, and aids shifting out of gear and minimizes slow shifting out of gear and returns the remote control to neutral, all with minimum backlash of the cables. The spring guide assembly includes an outer tube mounted to the shift plate, and a spring biased plunger axially reciprocal in the outer tube and mounted at its outer end to the shift lever.

U.S. Pat. No. 4,986,776 discloses a shift speed equalizer in a marine transmission in a marine drive subject to a decrease in engine speed upon shifting from neutral to a forward or reverse gear due to a high propeller pitch or the like, such as in bass boat applications, and subject to an increase in engine speed upon shifting back to neutral. The shift from neutral to forward or reverse is sensed, and engine speed is increased in response thereto, to compensate the decrease in engine speed due to shifting. The return shift back to neutral is sensed, and engine speed is decreased in response thereto, to compensate the increase in engine speed due to shifting. Engine speed is increased by advancing engine spark ignition timing, and engine speed is decreased by retarding or returning engine ignition timing to its initial setting. Particular methodology and structure is disclosed, including modifications to an existing shift plate and to an existing guide block to enable the noted functions, and including the addition of an auxiliary circuit to existing ignition circuitry enabling the desired altering of engine ignition timing to keep engine speed from dropping when shifting into forward or reverse.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,544,083 discloses a gear shift mechanism in which a cam structure comprises a protrusion that is shaped to extend into a channel formed in a cam follower structure. The cam follower structure can be provided with first and second channels that allow the protrusion of the cam to be extended into either which accommodates both port and starboard shifting mechanisms. The cam surface formed on the protrusion of the cam moves in contact with a selected cam follower surface formed in the selected one of two alternative channels to cause the cam follower to move axially and to cause a clutch member to engage with either a first or second drive gear.

U.S. Pat. No. 6,929,518 discloses a shifting apparatus for a marine propulsion device that incorporates a magneto-elastic elastic sensor which responds to torque exerted on the shift shaft of the gear shift mechanism. The torque on the shift shaft induces stress which changes the magnetic characteristics of the shift shaft material and, in turn, allows the magneto-elastic sensor to provide appropriate output signals representative of the torque exerted on the shift shaft. This allows a microprocessor to respond to the onset of a shifting procedure rather than having to wait for actual physical movement of the components of the shifting device.

U.S. Pat. No. 6,942,530 discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

U.S. Pat. No. 7,214,164 discloses shift operation control system for an outboard motor, which is capable of reducing a load that is acting on a shift operation lever during a shift operation and a shock occurring during the shift operation, to thereby facilitate the shift operation. The shift operation by the shift operation lever is continuously detected by a shift position detector, and when an early stage of the shift operation from the forward position to the neutral position or from the reverse position to the neutral position is detected and at the same time the engine speed at the detection is not less than a predetermined value, engine output reduction control is carried out, and when the shift position detector detects that the shift position has been switched to the neutral position, the engine output reduction control is canceled.

U.S. patent application Ser. No. 13/462,570 discloses systems and methods for controlling shift in a marine propulsion device. A shift sensor outputs a position signal representing a current position of a shift linkage. A control circuit is programmed to identify an impending shift change when the position signal reaches a first threshold and an actual shift change when the position signal reaches a second threshold. The control circuit is programmed to enact a shift interrupt control strategy that facilitates the actual shift change when the position signal reaches the first threshold, and to actively modify the first threshold as a change in operation of the marine propulsion device occurs.

U.S. patent application Ser. No. 13/760,870 discloses a system and method for diagnosing a fault state of a shift linkage in a marine propulsion device. A control lever is movable towards at least one of a maximum reverse position and a maximum forward position. A shift linkage couples the control lever to a transmission, wherein movement of the control lever causes movement of the shift linkage that enacts a shift change in the transmission. A shift sensor outputs a position signal representing a current position of the shift linkage. A control circuit diagnoses a fault state of the shift linkage when after the shift change the position signal that is output by the shift sensor is outside of at least one range of position signals that is stored in the control circuit.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, methods are for facilitating shift changes in a marine propulsion device having an internal combustion engine and a shift linkage that operatively connects a shift control lever to a transmission for effecting the shift changes amongst a reverse gear, a neutral gear and a forward gear. The methods can comprise: sensing a position of the shift linkage; sensing a speed of the engine; comparing the speed of the engine to a stored engine speed; and modifying, based upon the position of the shift linkage when the speed of the engine reaches the stored engine speed, a neutral state threshold that determines when the speed of the engine is no longer reduced to facilitate a shift change.

In certain other examples, systems are for facilitating shift changes in a marine propulsion device. The systems can comprise: an internal combustion engine; a shift linkage that operatively connects a shift control lever to a transmission for effecting the shift changes amongst a reverse gear, a neutral gear and a forward gear; a position sensor that senses position of the shift linkage; a speed sensor that senses speed of the engine; and a control circuit that compares the speed of the engine to a stored engine speed. The control circuit modifies, based upon the position of the shift linkage when the speed of the engine reaches the stored engine speed, a neutral state threshold that determines when the control circuit ceases reducing the speed of the engine to facilitate a shift change.

Various other aspects and exemplary combinations for these examples are further described herein below.

BRIEF DESCRIPTION OF THE DRAWINGS

Examples of methods and systems for facilitating shift changes in marine propulsion devices are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different methods and systems described herein may be used alone or in combination with other methods and systems. Various equivalents, alternatives, and modifications are possible within the scope of the appended claims.

Figure 1:
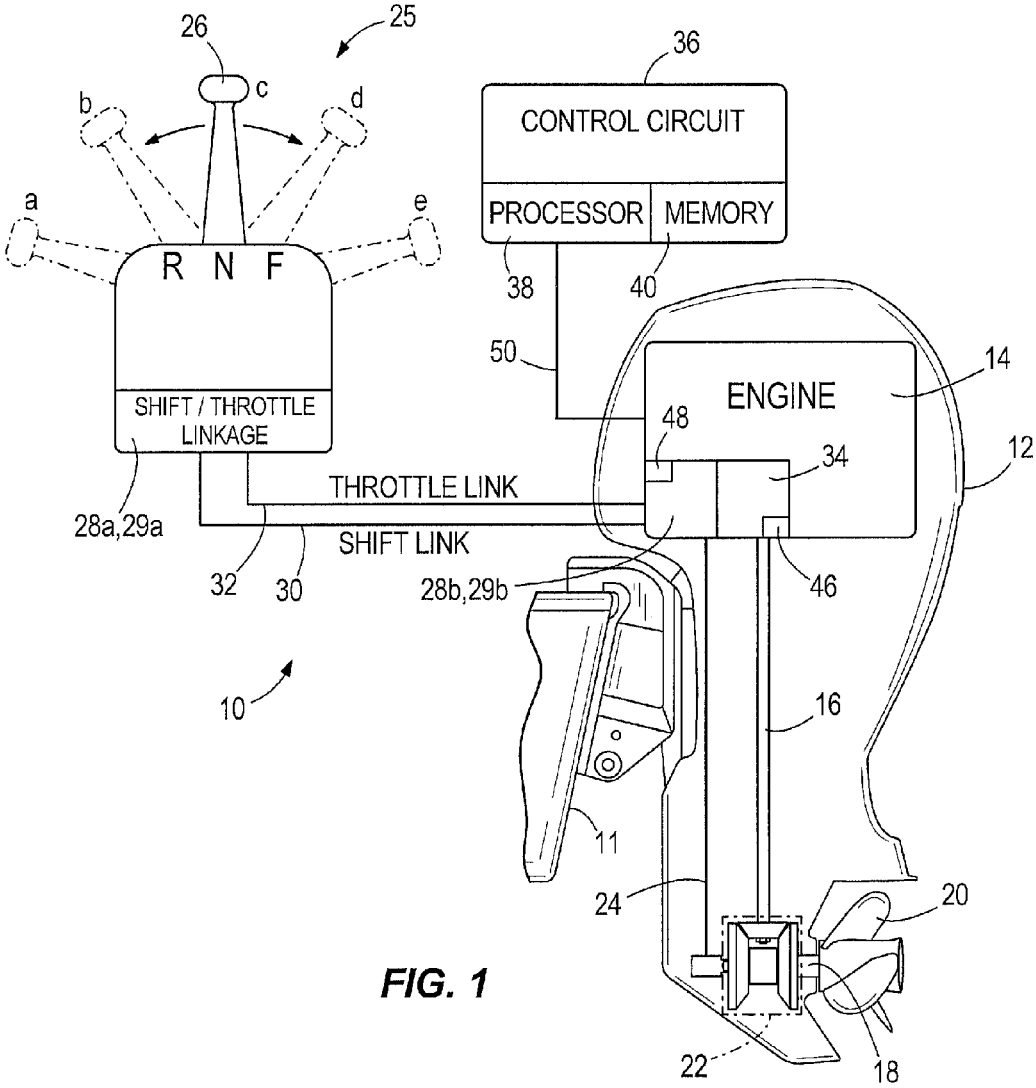
FIG. 1 is a schematic depiction of a shift control system for a marine propulsion device.

FIG. 1 depicts an exemplary shift control system 10 for a marine propulsion device 12 on a marine vessel 11. In the examples shown and described herein below, the marine propulsion device 12 is an outboard motor; however the concepts of the present disclosure are not limited for use with outboard motors and can be implemented with other types of marine propulsion devices, such as inboard motors, sterndrives, hybrid electric marine propulsion systems, pod drives and/or the like. In the examples shown and described, the marine propulsion device 12 has an internal combustion engine 14 causing rotation of a drive shaft 16 to thereby cause rotation of a propeller shaft 18. A propeller 20 connected to and rotating with the propeller shaft 18 propels the marine vessel 11 to which the marine propulsion device 12 is connected. The direction of rotation of propeller shaft 18 and propeller 20 is changeable by a transmission 22 having a clutch, which in the example shown is a conventional dog clutch; however many other types of clutches can instead or also be employed.

As is conventional, the transmission 22 is actuated between forward gear, neutral gear and reverse gear by a shift rod 24.

The shift control system 10 also includes a remote control 25 having an operator control lever 26, which in the example of FIG. 1 is a combination shift/throttle lever that is pivotally movable between a reverse wide open throttle position 26*a*, a reverse detent position (zero throttle) 26*b*, a neutral position 26*c*, a forward detent position (zero throttle) 26*d* and a forward wide open throttle position 26*e*, as is conventional. The remote control 25 typically is located remote from the marine propulsion device 12, for example at the helm of the marine vessel 11. The control lever 26 is operably connected to a shift linkage 28 and a throttle linkage 29, such that pivoting movement of the control lever 26 can cause corresponding movement of the shift linkage 28 and such that pivoting movement of the control lever 26 can cause corresponding movement of the throttle linkage 29. Portions 28*a* of the shift linkage 28 are typically located at the remote control 25 and other portions 28*b* of the shift linkage 28 are located at the engine 14. Similarly, portions 29*a* of the throttle linkage 29 are typically located at the remote control 25 and other portions 29*b* of the throttle linkage 29 are located at the engine 14. The shift linkage 28 also includes a shift link 30 that translates movement of the control lever 26 to the marine propulsion device 12, and ultimately to the shift rod 24, for causing a shift event (i.e. a change in gear) in the transmission 22. The shift link 30 can be for example a cable and/or the like. The throttle linkage 29 includes a throttle link 32 that translates movement of the control lever 26 to the engine 14 of the marine propulsion device 12, and ultimately to change the position of a throttle valve 34 of the engine 14. The throttle link 32 can be for example a cable and/or the like.

The shift control system 10 also includes a control circuit 36 that is programmable and includes a microprocessor 38 and a memory 40. The control circuit 36 can be located anywhere in the shift control system 10 and/or located remote from the shift control system 10 and can communicate with various components of the marine vessel 11 via wired and/or wireless links, as will be explained further herein below. The control circuit 36 can have one or more microprocessors that are located together or remote from each other in the shift control system 10 or remote from the system 10. Although FIG. 1 shows a single control circuit 36, the shift control system 10 can include more than one control circuit 36. For example, the shift control system 10 can have a control circuit 36 located at or near the control lever 26 and can also have a control circuit 36 located at or near the marine propulsion device 12. Each control circuit 36 can have one or more control sections. One having ordinary skill in the art will recognize that the control circuit 36 can have many different forms and is not limited to the example that is shown and described.

In this example, the control circuit 36 communicates with one or more components of the marine propulsion device 12 via a communication link 50, which can be a wired or wireless link. The control circuit 36 is capable of monitoring and controlling one or more operational characteristics of the marine propulsion device 12 by sending and receiving control signals via the communication link 50. In this example, a throttle valve 34 is provided on the engine 14 and a throttle valve position sensor 46 senses the position of the throttle valve 34, which is movable between open and closed positions. The throttle valve position sensor 46 provides signals to the control circuit 36 via the link 50 indicating the current position of the throttle valve 34.

The control circuit 36 is also configured to at least receive position signals from a shift sensor 48 sensing a current position of the shift linkage 28. The control circuit 36 communicates with the shift sensor 48 via the communication link 50, which can be a wired or wireless link. In this example, the shift sensor 48 includes a potentiometer and an electronic converter, such as an analog to digital converter that outputs discrete analog to digital (ADC) counts that each represent a position of the shift linkage 28. Such potentiometer and electronic converter combinations are known in the art and commercially available for example available from CTS Corporation.

Figure 2:
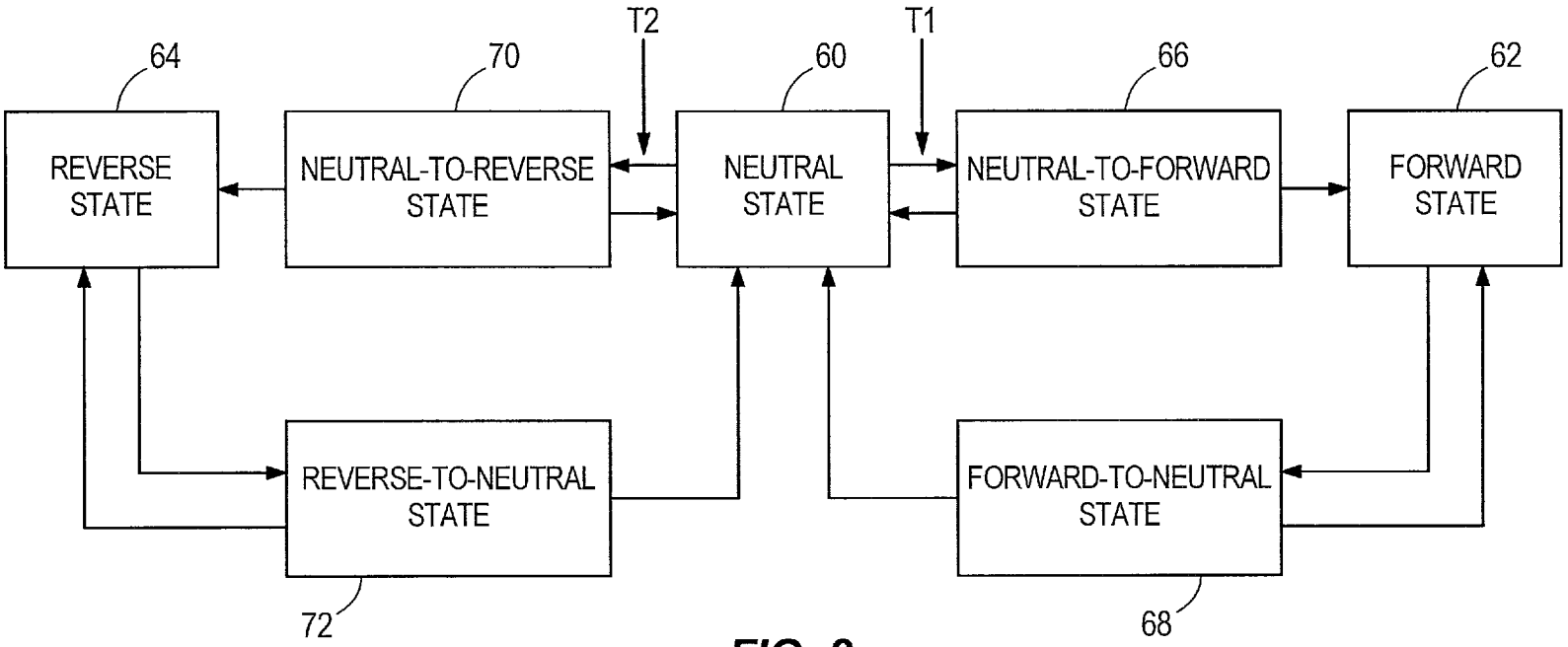
FIG. 2 is a state flow diagram depicting states of a shift control system for a marine propulsion device.

FIG. 2 is a stateflow diagram depicting several different operational modes or "control states" of the control circuit 36. In each control state, the control circuit 36 follows a protocol, as will be explained further herein below, to obtain a desired functional/operational output from the marine propulsion device 12 that is commensurate with operator inputs to the control lever 26. In this example, the control circuit 36 is programmed to control the speed of the engine 14 based upon a current position of the control lever 26 about its pivot axis. More specifically, as the control lever 26 is pivoted, the shift sensor 48 outputs discrete ADC counts to the control circuit 36 based upon the position of the shift linkage 28. Each ADC count corresponds to a position of the control lever 26 with respect to its pivot access. As will be explained further herein below, the control circuit 36 compares the current ADC count to a threshold and then commands that the engine 14 of the marine propulsion device 12 act according to a certain control state based upon the comparison, to thereby facilitate easier shifting by the marine propulsion device 12.

As described in the incorporated U.S. Pat. No. 6,942,530, shifting from one gear position to another gear position (such as from neutral gear to forward gear) can often result in significant impact noise and/or impact shock to the marine propulsion device, and particularly its drive components. This noise and/or shock results from the impact that occurs between moving parts of the clutch, for example. The amount of noise and/or shock is often proportional to the speed of the engine 14. The faster the speed of the engine 14, the more noise and/or shock, and vice versa. Shifting from one gear position to another gear position (such as from forward gear to neutral gear) can often cause a significant load to be placed on the shift mechanism. The faster the speed of the engine 14, the more load on the shift mechanism, and vice versa. During a shift event, it can therefore be desirable to briefly reduce the speed of the engine 14 in order to facilitate a shift event having less noise and/or shock and/or a shift event encountering reduced load. The speed of the engine 14 can be reduced by implementing one of several known shift interrupt control strategies, several of which are disclosed in the above referenced U.S. Pat. No. 6,942,530, which are described in the context of reducing noise and/or shock. These shift interrupt control strategies can also be used to reduce the load. Shift interrupt control strategies can include varying spark ignition, varying engine torque profile, interrupting ignition, reducing engine torque, varying throttle valve position, interrupting engine ignition circuit, cutting fuel, opening the idle air control valve, just to name just a few. Implementing any one of these shift interrupt control strategies can cause the speed of the engine 14 to slow, thus decreasing the torque provided to the drive train, including the noted clutch.

In the present disclosure, the control circuit 36 is programmed to enact a selected shift interrupt control strategy that briefly lowers the speed of the engine when the position signal provided by the shift sensor 48 reaches a threshold. As will be explained further herein below, advantageously, the control circuit 36 is also programmed to actively modify one or more threshold as a change in operation of the marine propulsion device 12 occurs, such as for example a change in a position of the throttle valve 34, as sensed by the throttle valve position sensor 46.

As explained herein above, the control circuit 36 is programmed to compare the current position signal (here an ADC count) outputted by the shift sensor 48 to a threshold. When the position signal reaches the threshold, the control circuit 36 enacts a new control state. It should be understood that the control circuit 36 can follow generally the same protocol during a shift from neutral gear to reverse gear as it does during a shift from neutral gear to forward gear. Also, the control circuit 36 can follow generally the same protocol during a shift from reverse gear to neutral gear as it does during a shift from forward gear to neutral gear. As such, for discussion purposes and for brevity, an exemplary control circuit 36 protocol during a shift from neutral gear to forward gear, and back to neutral gear is discussed herein below.

Referring to FIG. 2, the control circuit 36 can be programmed with a threshold indicating a change from a Neutral State 60 to a Neutral-to-Forward State 66 in which the control circuit 36 can optionally be programmed to enact a shift interrupt control strategy, as described herein above. The control circuit 36 can also be programmed with another threshold indicating a change from Neutral-to-Forward State 66 to Forward State 62, at which point the control circuit 36 can optionally be programmed to stop enacting the noted shift interrupt control strategy. The control circuit 36 can further be programmed with another threshold indicating a change from the Forward State 62 to a Forward-to-Neutral State 68 during which state the control circuit 36 can be programmed to enact one or more of the noted shift interrupt control strategies. The value of the threshold indicating a change from Forward State 62 to Forward-to-Neutral State 68 can be different than the value of the threshold indicating a change from Neutral-to-Forward State 66 to Forward State 62. The control circuit 36 can be programmed with another threshold indicating a change from Forward-to-Neutral State 68 to the Neutral State 60, wherein the control circuit 36 can be programmed to stop enacting the noted shift interrupt strategy. As discussed above, this same type of protocol can apply in reverse, i.e. when a shift request is entered at the control lever 26 for neutral to reverse shift and thereafter for reverse to neutral shift, wherein the control circuit 36 is programmed to employ a Neutral-to-Reverse State 70, Reverse State 64, and Reverse-to-Neutral State 72.

As described herein above, the shift control system 10 is a mechanical system wherein manual inputs from the operator directly actuate the shift event. Thus the control circuit 36 has an observational role relative to the actual shifting event because the shifting event is largely controlled by mechanical connections in the marine propulsion device 12, including among other things the connections between the control lever 26, shift linkage 28, shift rod 24, and clutch. However the control circuit 36 can control characteristics of the engine 14 based upon the sensed operator inputs to the control lever 26 and more specifically based upon sensed movements of the shift linkage 28, for example. In this example, mechanical tolerances and connections between the noted control lever 26, shift linkage 28 (including portions 28*a*, 28*b* and shift link 30) will vary for each marine propulsion device 12. Because of this variability, the noted thresholds that are programmed in the control circuit 36 at the time the shift control system 10 is initially configured, which thresholds typically represent common or estimated positions of the shift linkage 28 at which a shift event most likely occurs, will not necessarily accurately reflect such a result in every system. The difference between the thresholds that are programmed when the shift control system 10 is initially configured and the actual positions at which changes in shift states occur can vary. For example, the position of the shift linkage 28, will not always accurately and/or precisely predict and/or represent the position at which an actual shift event occurs at the transmission 22. Each system will have slightly different physical characteristics, which causes the correlation between the position of the control lever 26 and actuation of the clutch to vary and be unpredictable at the time of initial configuration of the shift control system 10.

Figure 3:
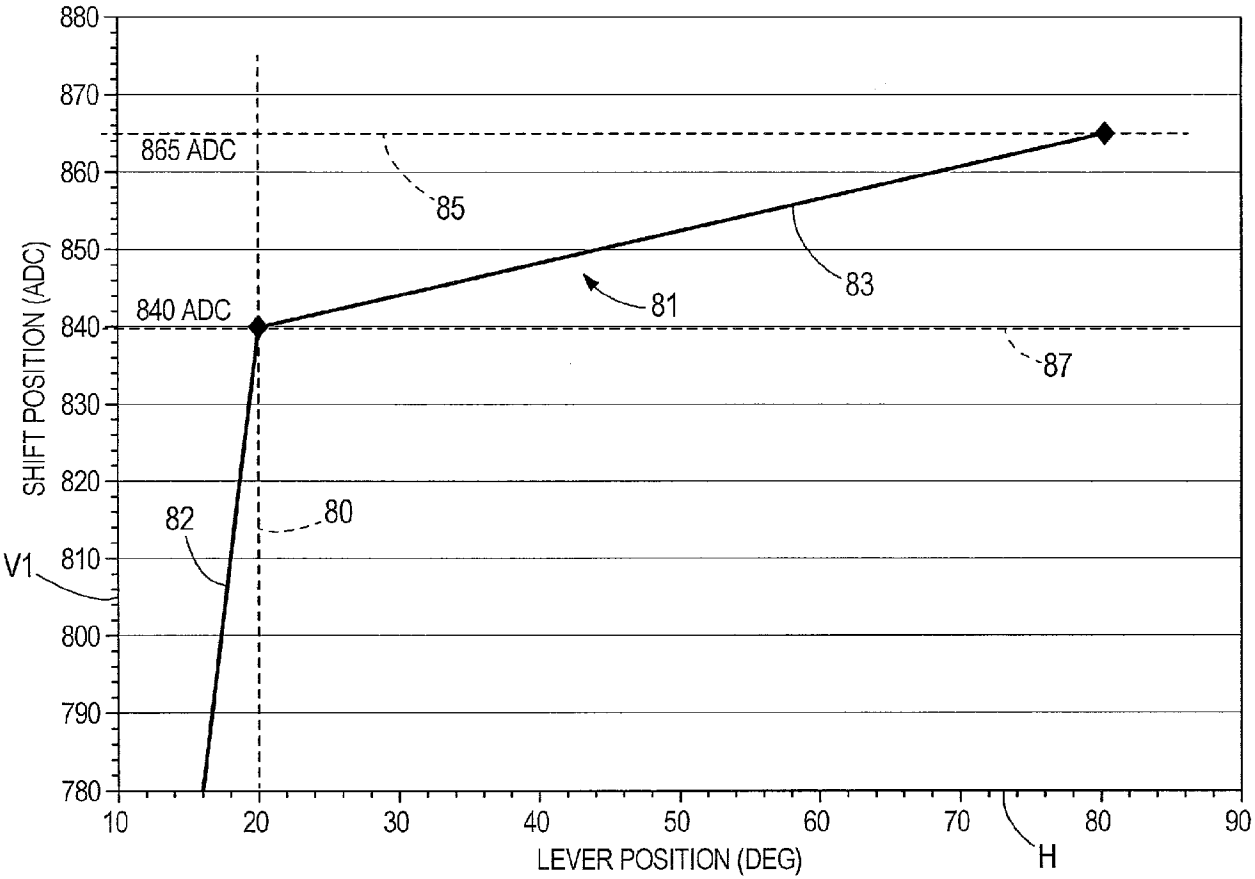
FIG. 3 is a graph depicting sensed movement of a shift linkage during a shift event.

FIG. 3 graphically depicts the above-described concepts in an exemplary shift linkage 28. The vertical axis V1 designates a range of analog to digital counts (ADC). The horizontal axis H designates a range of angular position of the control lever 26 with respect to a vertical or neutral N position. Dashed line 80 designates the angle of the control lever 26 at which a shift event actually occurs. In this example, the angle is twenty degrees. Solid line 81 designates the shift position signal (ADC) output by the shift sensor 48 as the control lever 26 is pivoted about its axis. In this example, the shift position signal is 840 ADC when the actual shift event occurs at the noted twenty degrees. Dashed horizontal line 85 represents an ADC count at which the shift linkage 28 stops moving. Dashed horizontal line 87 designates the position signal (here, 840 ADC) output by the shift sensor 48 when the actual shift event occurs. The line 81 thus has a first portion 82 that shows the shift position signal (ADC) up until when the actual shift event occurs at twenty degrees. The line 81 also has a second portion 83 that shows changes in the shift position signal (ADC) after the actual shift event occurs. Second portion 83 thus illustrates additional movement of the shift linkage 28 after the actual shift event has occurred. This is movement is lost or wasted motion in the mechanical system. More particularly, the second portion 83 illustrates lost motion in the shift linkage 28 (including the associated shift link 30) that occurs during movement of the control lever 26 from the forward detent position 26*d* to the forward wide open throttle position 26*e*. This motion of the shift linkage 28 does not impact or otherwise accurately predict the timing of the actual shift event. The slope and magnitude of second portion 83 will vary depending upon the particular marine propulsion device and depending upon the particular thresholds that are selected, for example when the shift control system 10 is configured and the particular physical characteristics of the shift linkage 28.

Figure 4:
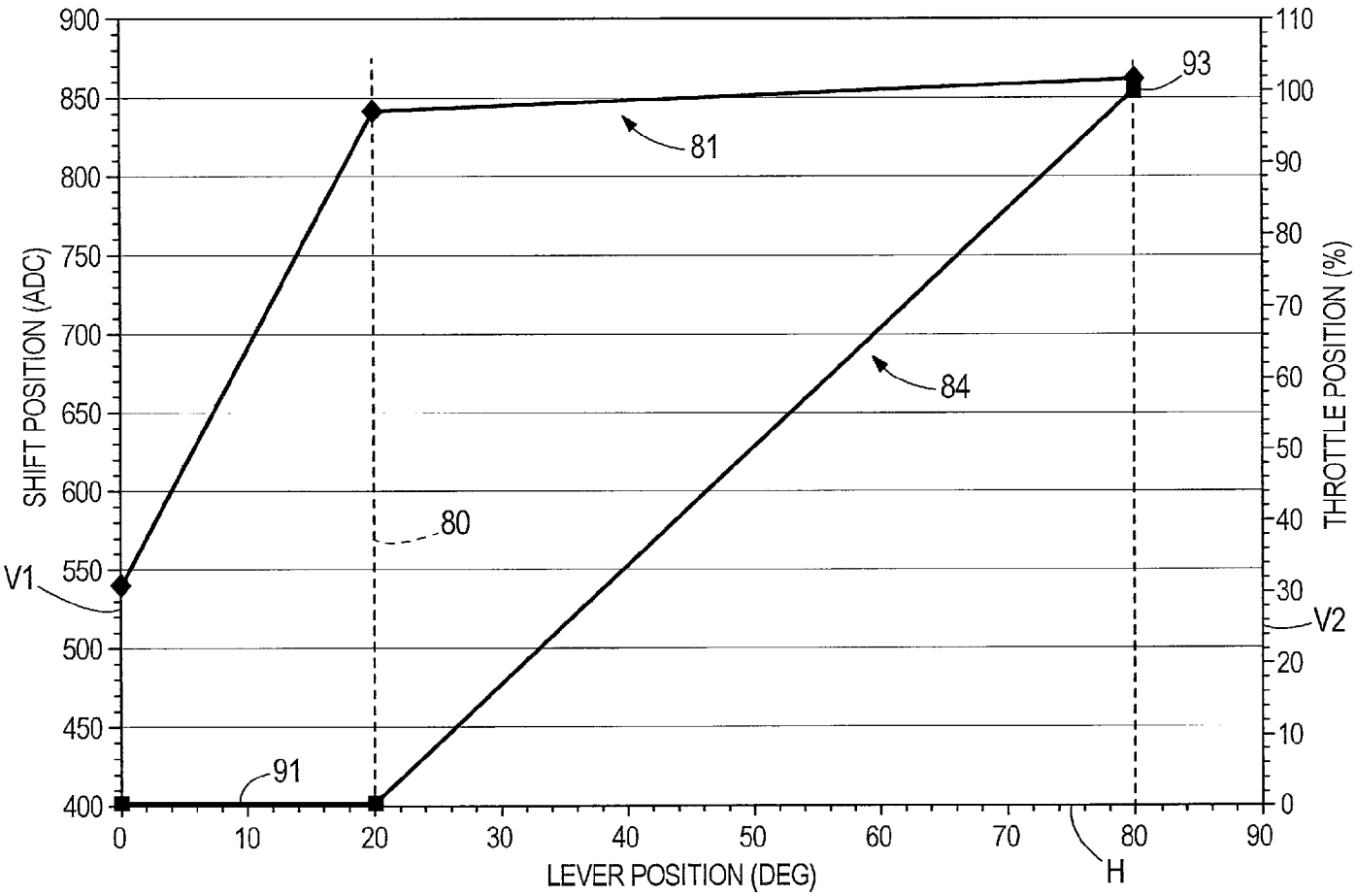
FIG. 4 is a graph depicting sensed movement of a shift linkage and a throttle linkage during a shift event.

Like FIG. 3, FIG. 4 depicts the shift position signal (solid line 81) that is output by the shift sensor 48. Line 84, FIG. 4, depicts the percent opening of the throttle valve 34 of the engine 14 during the movement of the control lever 26. Vertical axis V2 indicates the percent opening of throttle valve 34. Once the actual shift event occurs at twenty degree lever position, the throttle valve 34 gradually opens from a closed throttle valve position at 91 to a fully open throttle valve position at 93.

Through research and development efforts, the present inventors have recognized that because of unpredictability and lost motion encountered in mechanically based systems, it is desirable to provide a control system that actively modifies one or more of the noted thresholds for changing control states of the control circuit 36. By actively modifying these threshold(s), it is possible to more precisely (timely) implement shift interrupt control strategies prior to an actual shift event, which in turn provides efficiency in the shift change by for example reducing the impact and/or noise of the event. The inventors have also recognized that the shift control system 10 can be programmed to modify one or more noted thresholds, for example based upon movement of the throttle valve 34 between its closed and open state, which correlates to actual gear position of the marine propulsion device 12. By sensing the position of the throttle valve 34 and correlating throttle valve 34 position to the actual shift condition, the shift control system 10 is able to more accurately implement the shift interrupt control strategy at an optimal time. In other words, the throttle valve 34 will typically change position upon an actual shift event. This information can therefore be used by the control circuit 36 to modify the noted thresholds and more precisely implement the shift interrupt control strategy.

Referring back to FIG. 2, the shift control system 10 is programmed to actively modify one or more of the noted thresholds to achieve the above described advantages. For example, the threshold indicating a change from the Forward State 62 to the Forward-to-Neutral State 68 can be actively modified based upon a present condition of the throttle valve 34 associated with the engine 14. More specifically, the control circuit 36 can receive signals from the throttle valve position sensor 46 indicating the position of the throttle valve 34. The control circuit 36 can compare the signals it receives from the throttle valve position sensor 46 to a predetermined or calibratable amount, which can be for example a certain percent opening of the throttle valve 34. Until the signal from the throttle valve position sensor 46 reaches the predetermined or calibratable amount, the control circuit 36 can be programmed to modify the noted threshold indicating a change from Forward State 62 to Forward-to-Neutral State 68 by a predetermined or calibratable amount. For example, the threshold can be modified by 50 ADC counts, thus requiring the shift sensor 48 to indicate to the control circuit 36 that the shift linkage 28 has moved an amount equivalent to an additional 50 ADC counts before the control circuit 36 commands initiation of the noted shift interrupt control strategy. The control circuit 36 is thus programmed to modify the threshold indicating a change from Forward State 62 to Forward-to-Neutral State 68 based upon the value of the position signal generated by the shift sensor 48 until the time when the throttle valve position sensor 46 senses a certain change in position of the throttle valve 34. Thereafter, once the position signal output by the shift sensor 48 reaches the modified threshold indicating a change from the Forward State 62 to the Forward-to-Neutral State 68, the control circuit 36 is programmed to enact the noted shift interrupt control strategy.

Figure 5:
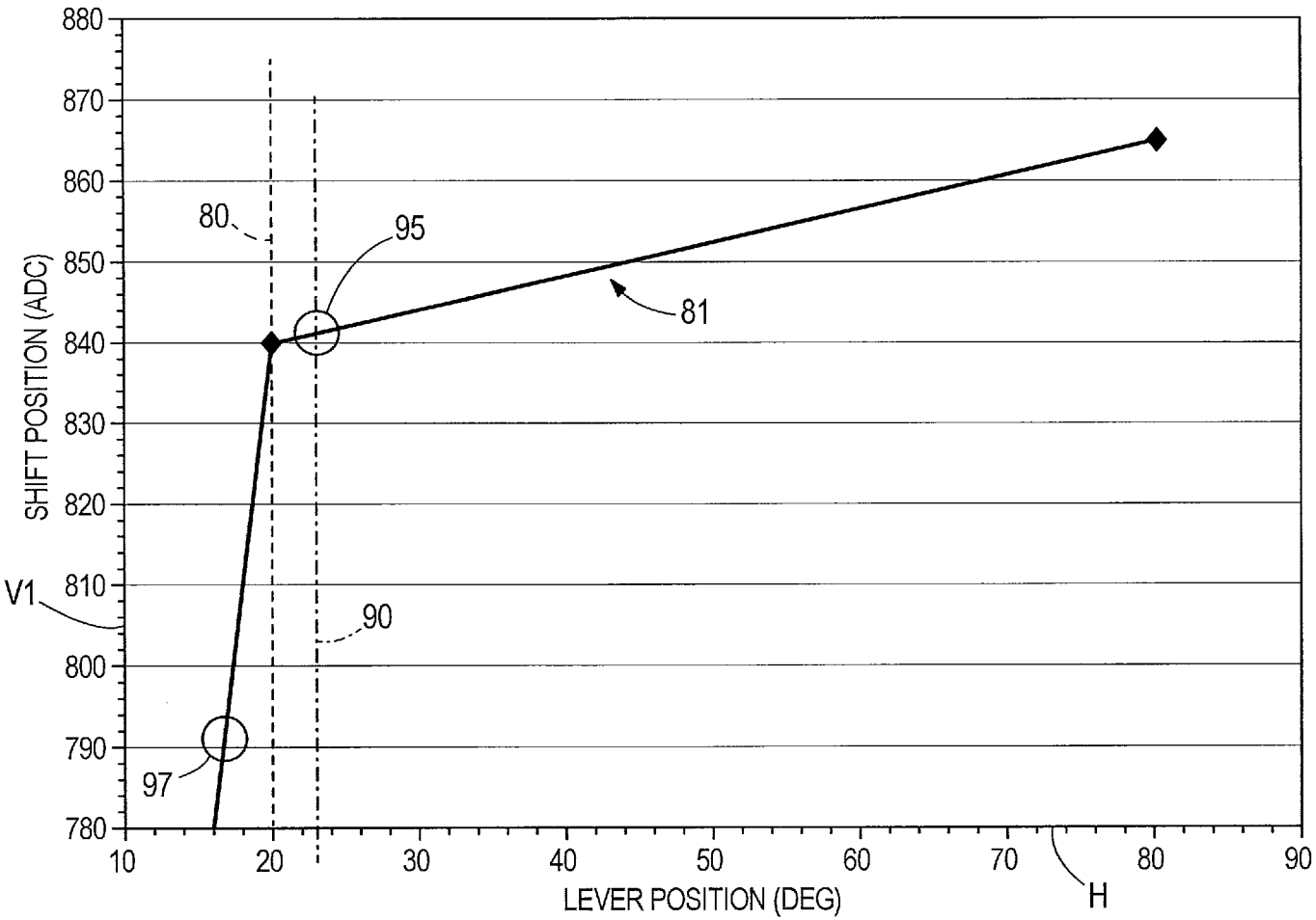
FIG. 5 is a graph depicting sensed movement of a shift linkage and throttle linkage during a shift event, and also depicting modified thresholds for enacting a shift interrupt control strategy.

FIG. 5 shows one example. A dash-and-dot line 90 designates the angular position of the control lever 26 at which the throttle valve 34 reaches a 5% open position, as sensed by the throttle valve position sensor 46. At this point, the shift sensor 48 outputs an 842 ADC count, as shown at circle 95. Until this value is reached, the control circuit 36 is programmed to modify the threshold for enacting the shift interrupt strategy. Here the control circuit 36 is programmed to implement a modified threshold that is 50 ADC different from the 842 ADC (i.e. 792 ADC) as shown at circle 97. Therefore, the control circuit 36 will enact the shift interrupt strategy once the shift sensor 48 outputs 792 ADC. The amount of the modification, which here is 50 ADC, is an amount that can be calibrated and therefore can vary depending upon design criteria for the particular shift control system 10.

Figure 6:
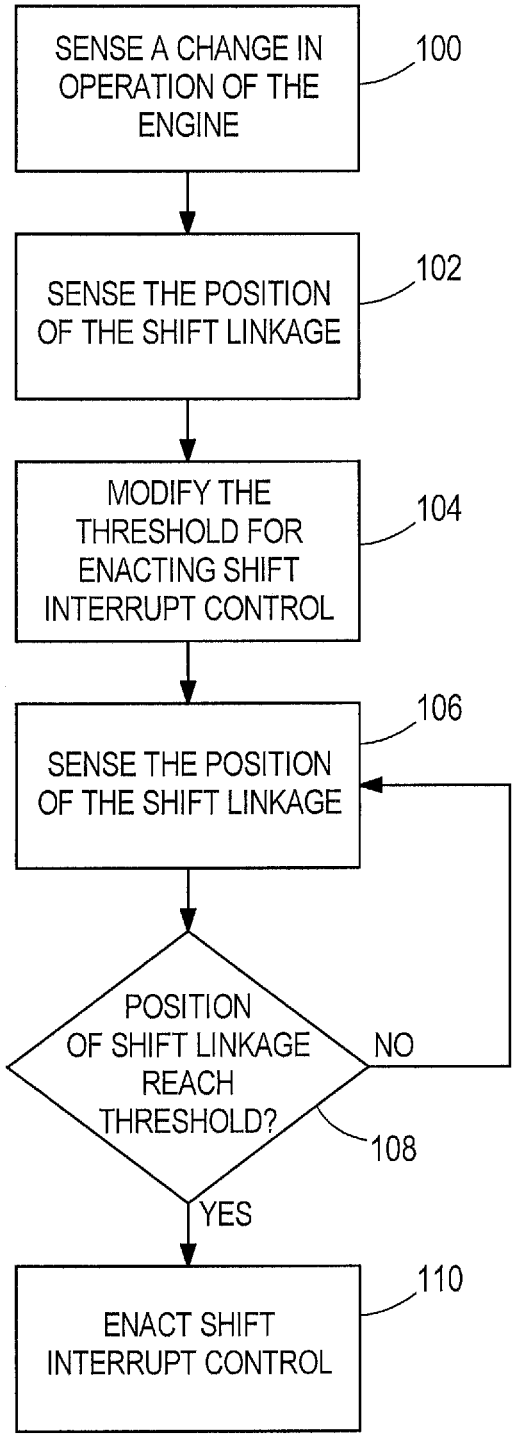
FIG. 6 is a flow chart depicting steps in one example of a method of controlling shift in a marine propulsion device.

FIG. 6 depicts one example of a method of controlling shift in a marine propulsion device, such as marine propulsion device 12. This method can be employed, for example, during a shift from forward gear into neutral gear. Alternately, as described herein above, this method can be employed, for example during a shift from reverse gear into neutral gear. At step 100, the control circuit 36 and throttle valve position sensor 46 are configured to sense a change in operation of the engine 14, which in this example is a change in percent opening of the throttle valve 34. At step 102, the shift sensor 48 senses the current position of the shift linkage 28 and communicates a position signal to the control circuit 36. At step 104, the control circuit 36 is programmed to modify a threshold for enacting a shift interrupt control strategy based upon the information acquired during steps 100 and 102, as described herein above. The threshold can be modified by a predetermined amount, for example 50 ADC or some other amount, which can vary and can be calibrated for each system. At step 106, the control circuit 36 and shift sensor 48 are programmed to sense the position of the shift linkage 28. At step 108, the control circuit 36 compares the sensed position of the shift linkage 28 to the modified threshold that was obtained at step 104. If the position of the shift linkage 28 reaches the modified threshold, at step 110, a shift interrupt control strategy is enacted by the control circuit 36. If the position of the shift linkage has not reached the modified threshold, the control circuit 36 continues to sense the position of the shift linkage at step 106 and make the comparison at step 108.

Referring to FIG. 2, after the shift interrupt control strategy is implemented (in this example at the Forward-to-Neutral State 68), the control circuit 36 can also be programmed to stop enacting the noted shift interrupt control strategy based upon an occurrence of certain criteria. For example, if the shift sensor 48 provides a position signal to the control circuit 36 that reaches the noted threshold indicating a change from the Forward-to-Neutral State 68 to Neutral State 60, the control circuit 36 can stop enacting the shift interrupt control strategy. Alternately, if the control lever 26 is moved back towards the forward detent position **26*d* by a certain amount and the shift sensor 48 provides a position signal to the control circuit 36 that is different than the noted threshold indicating a change from the Forward State 62 to the Forward-to-Neutral State 68 by a certain amount, the control circuit 36 can be programmed to stop enacting the shift interrupt control strategy. These two scenarios will be described further herein below with reference to FIG. 7**.

Figure 7:
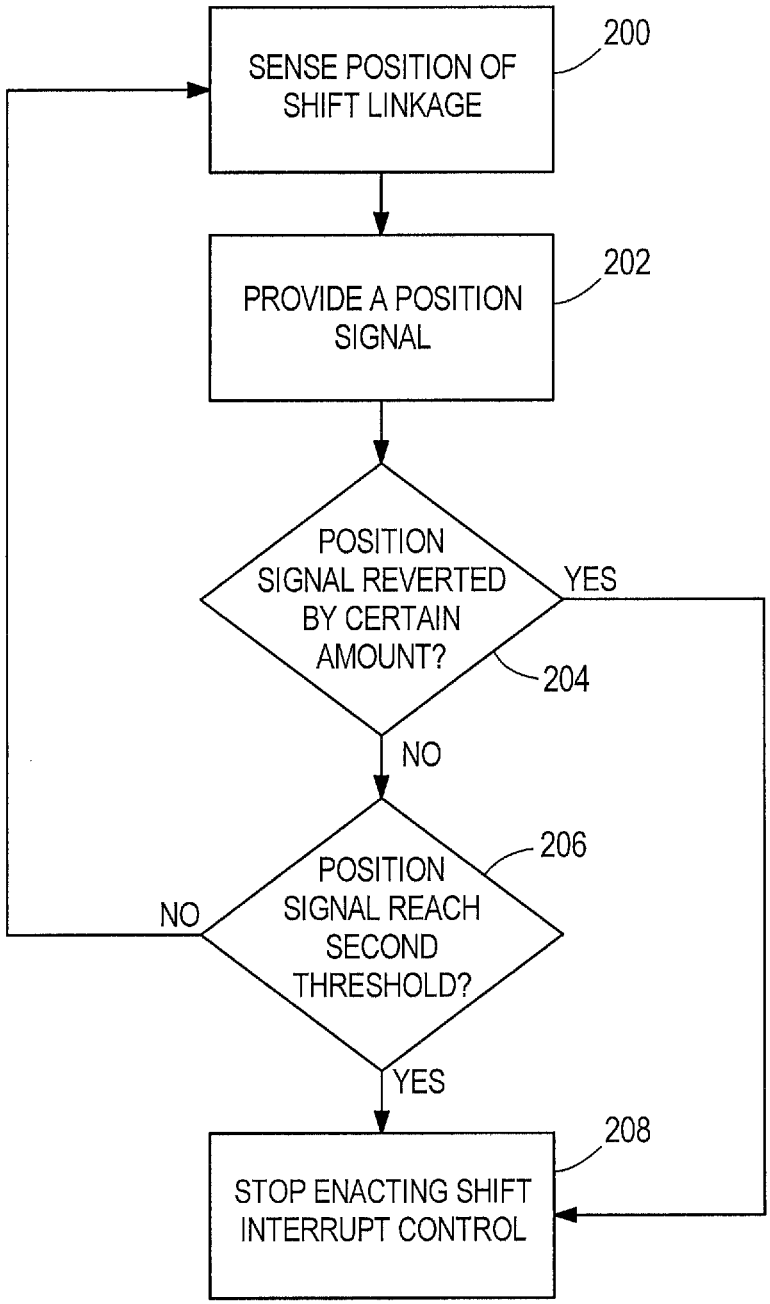
FIG. 7 is a flow chart depicting steps in another example of a method of controlling shift in a marine propulsion device.

FIG. 7 depicts another example of a method of controlling shift in a marine propulsion device, such as the marine propulsion device 12. The example shown in FIG. 7 can be utilized once the control circuit 36 has begun a shift interrupt control strategy at the Forward-to-Neutral State 68 or the Reverse-to-Neutral State 72. At step 200, the shift sensor 48 senses the position of shift linkage 28. At step 202, the shift sensor 48 provides a position signal to the control circuit 36 representing the current position of the shift linkage 28. At step 204, the control circuit 36 compares the position signal provided by the shift sensor 48 to a threshold for reverting back to a previous gear position. The threshold can vary and can be calibrated for the particular system in which the method is employed. If the position signal sensed at step 202 has reverted by the certain amount, the control circuit 36 is configured to stop enacting shift interrupt control at step 208. If the position signal has not reverted by the noted amount, at step 206, the control circuit 36 compares the position signal provided by shift sensor 48 to a second threshold for determining whether a shift change from Forward-to-Neutral State 68 to Neutral State 60 is reached. The second threshold can vary and can be calibrated for the particular system in which the method is employed. If the second threshold is reached, the control circuit 36 is programmed to stop enacting the shift interrupt control strategy 208. If not, the control circuit 36 and shift sensor 48 continue sensing the position of the shift linkage at step 200.

During additional research and development efforts, the present inventors have recognized that it is desirable to more accurately and consistently identify the noted "second threshold" identified herein above at step 206. In other words, the inventors have recognized that it is desirable to more accurately and consistently identify the upper and lower thresholds T1 and T2 of the Neutral State 60 shown in FIG. 2. The present inventors have realized that by more precisely identifying the thresholds T1, T2 of the Neutral State 60 it is possible to provide a more efficient (e.g. timely) application of the shift interrupt and/or shift-anti-clunk control strategies discussed herein above.

Figure 8:
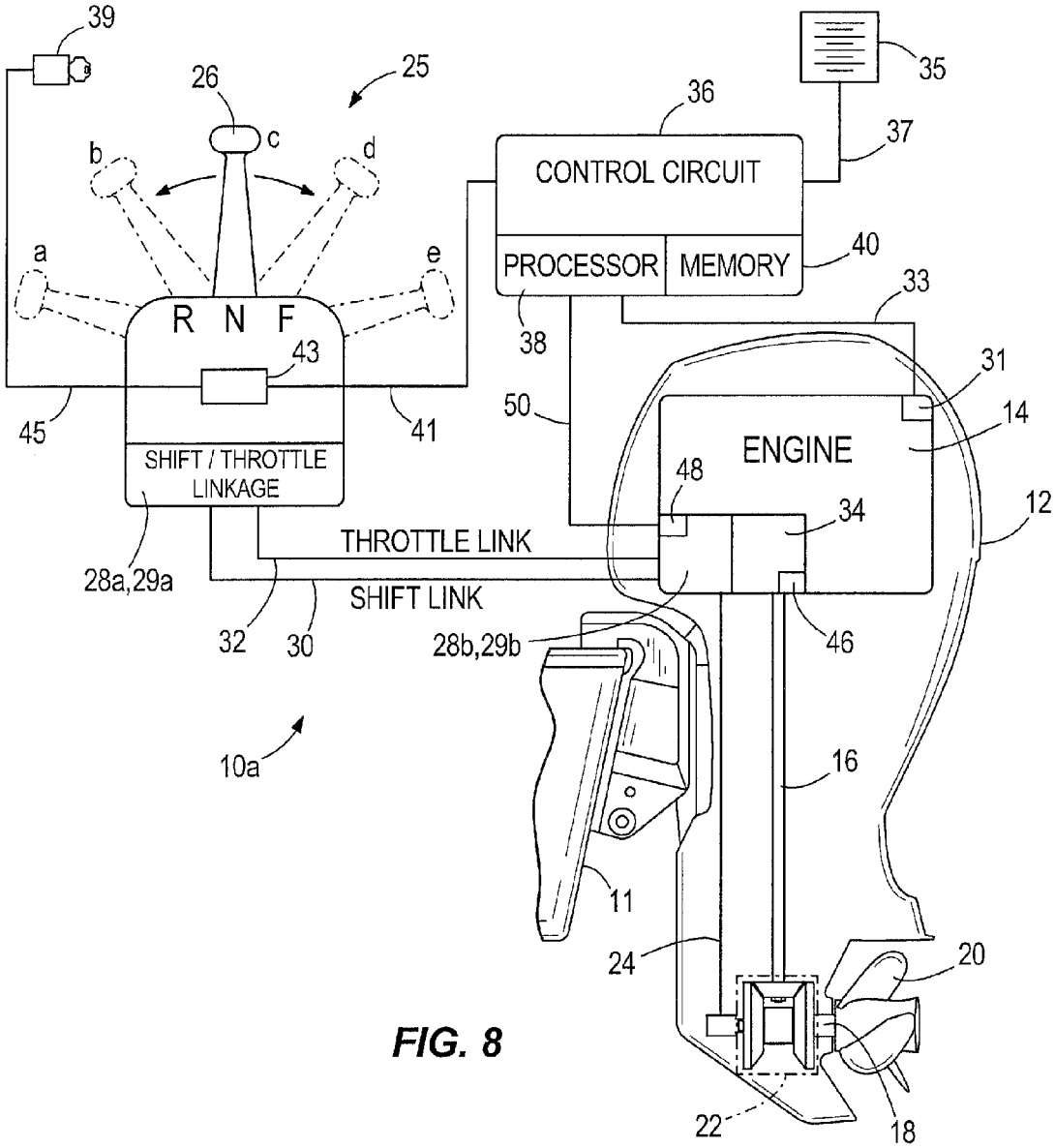
FIG. 8 is schematic depiction of another shift control system for a marine propulsion device.

FIG. 8 depicts an exemplary system 10*a* for accomplishing these objectives. The system 10*a* is very similar to the system 10 shown in FIG. 1, except the system 10*a* also includes an engine speed sensor 31 that senses speed of the engine 14. The type of engine speed sensor 31 can vary, and in some examples can be a conventional encoder device that is connected in a known way to a fly wheel of the engine 14 for sensing rotations per minute (RPMs) of the engine 14. The engine speed sensor 31 communicates the speed of the engine 14 to the control circuit 36 via a wired or wireless communication link 33. The system 10*a* also can include a conventional battery 35 for providing power to the control circuit 36 via an electrical power line 37. The system 10*a* can also include a conventional key and key receptacle 39 by which an operator can "key-up" the system 10 and thereby in a known way cause power from the battery 35 to be provided to the control circuit 36 via the electrical power line 37. The key receptacle 39 can be connected to the control circuit 36 via a wired link 45 and a wired or wireless communication link 41. Also, via the key and key receptacle 39 and/or another conventional operator input device, the operator can in a known way instruct the control circuit 36 to cause the engine 14 to enter a crank state wherein the engine 14 is cranking and then enter a run state wherein the engine 14 is running, all as is conventional. The configuration of the key and key receptacle 39 and/or the other input device are conventional and can vary from that which is shown and in some examples can also or alternatively include one or more wireless key fobs, push buttons, touch screens and/or the like for inputting operator requests for key-up of the system 10*a* and crank and run of the engine 14. The system 10*a* can also be configured with a conventional safety feature, wherein the engine 14 is prevented from starting unless the control lever 26 is located in the neutral position 26*c*. The remote control 25 is constructed such that the key receptacle 39 is routed through a neutral safety switch 43 via link 45. The neutral safety switch 43 is in the closed or conducting state only when the control lever 26 is in the neutral position 26*c*. This ensures that when the operator errantly attempts to start the engine 14 when the control lever 26 is in forward or reverse gear, the engine 14 does not start and therefore the marine propulsion device 12 does not unexpectedly rotate the propeller 20 and propel the marine vessel 11.

As in the examples described herein above with respect to FIG. 1, the control circuit 36 shown in FIG. 8 can monitor the position of the shift linkage 28, as sensed by the shift sensor 48. In addition, the control circuit 36 in FIG. 8 is configured to monitor the speed of the engine 14, as sensed by the engine speed sensor 31, and thereafter compare the speed of the engine 14 to a known engine speed that is stored in the memory 40. In some examples, the stored engine speed is a known speed at which the engine 14 typically changes from the crank state to the run state. In other examples, the stored engine speed is a known speed that occurs upon a shift change from one of the forward and reverse gears to the neutral gears. These known speeds can be obtained through experimentation and/or historical knowledge of the particular system in which the control circuit 36 is configured to operate.

In a first example, each time the engine 14 transitions from the crank state to the run state, the control circuit 36 can assume that the control lever 26 is in the neutral position 26*c* (because as stated above the system 10*a* is configured to prevent the engine 14 from starting unless the operator control lever 26 is in the neutral position 26*c*). Based on this assumption, the control circuit 36 can then actively modify upper and lower limits T1, T2 (see FIG. 2) of the Neutral State 60 each time the output of the speed sensor 31 indicates that the engine 14 has transitioned from the crank state to the run state. This consistently provides a more accurate adaptation of the upper and lower limits T1, T2 as compared to prior art systems and methods. More specifically, the control circuit 36 is configured to identify the position of the shift linkage 28 when the speed of the engine 14 reaches a stored engine speed, which in this example is a known speed at which the engine typically changes from the crank state to the run state. Thereafter, the control circuit 36 is configured to calculate new upper and lower limits T1, T2 of the Neutral State 60 by adding and subtracting predetermined/calibrated amounts to and from the position of the shift linkage 28 when the speed of the engine 14 reaches the stored engine speed. The predetermined/calibrated (stored) amounts can vary depending on the particular system and can be stored in the memory 40.

As discussed herein above with respect to FIG. 2, the upper and lower limits T1 and T2 determine when the control circuit 36 enacts/ceases enacting the noted shift interrupt control strategy and/or shift anti-clunk control strategy to reduce the speed of the engine 14 and thereby facilitate a shift change out of and/or into neutral gear. Therefore in this example, after the upper and lower limits T1, T2 of the Neutral State 60 are calculated, the control circuit 36 is programmed to implement the shift interrupt control strategy and/or shift anti-clunk control strategy, and then continue to monitor the position of the shift linkage 28 (via the inputs from the shift sensor 48), and thereafter cease its implementation of the shift interrupt control strategy and/or shift anti-clunk control strategy (i.e. its reduction of the speed of the engine 14) when the shift sensor 48 indicates that the shift linkage 28 has again reached (i.e. returned to) the adapted upper or lower limit T1, T2. In other words, the upper and lower limits T1, T2 of the Neutral State 60 can also designate a lower threshold of the Forward-to-Neutral State 68 and a lower threshold of the Reverse-to-Neutral State 72 in which the speed of the engine 14 is controlled to facilitate the shift change.

Figure 9:
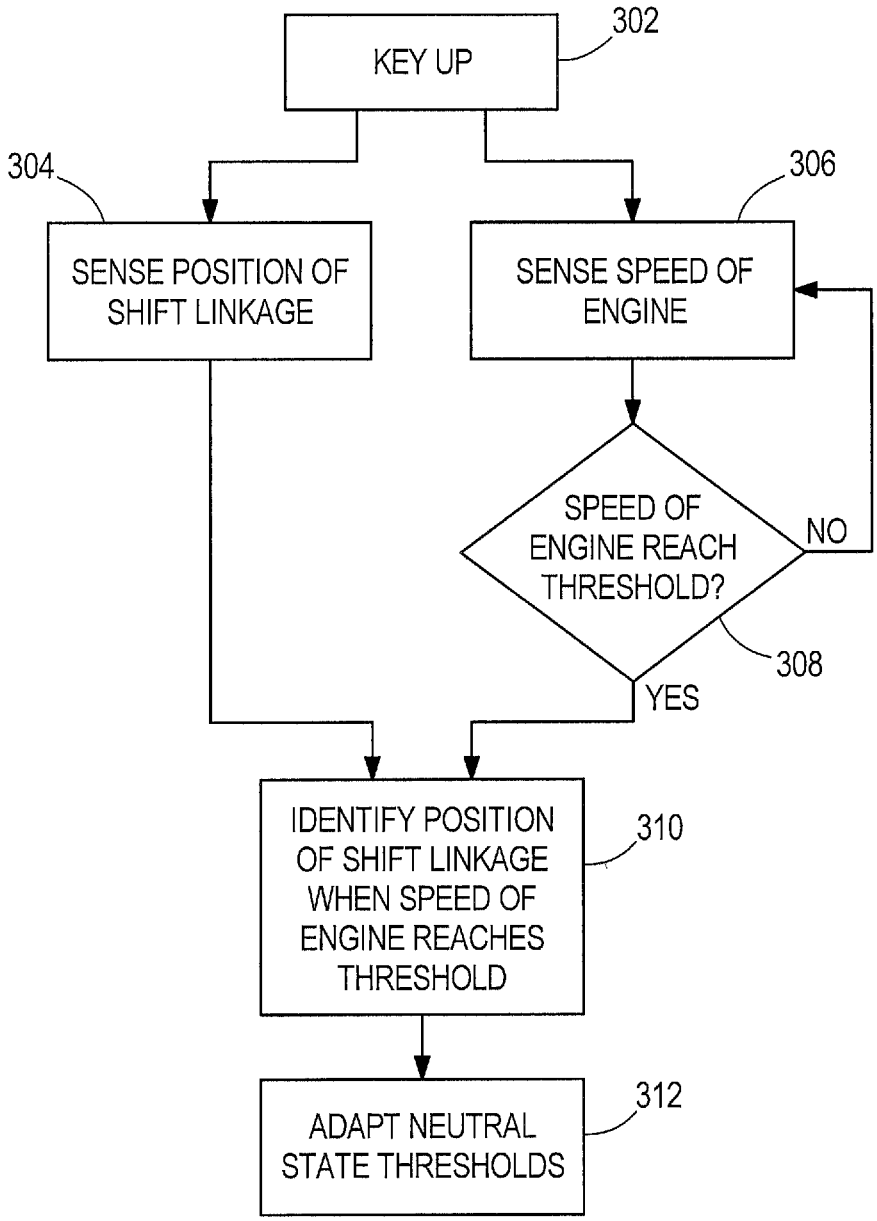
FIG. 9 is a flow chart depicting steps in an example of a method for facilitating shift changes in marine propulsion devices.

FIG. 9 depicts one example of a method according to this example. At step 302, the operator initiates key-up of the system 10*a*. At step 304, the shift position sensor 48 senses the position of the shift linkage 28 and communicates this information to the control circuit 36 via the link 50. At step 306, the engine speed sensor 31 senses the speed of the engine 14 and communicates this information to the control circuit 36 via the link 33. At step 308, the control circuit 36 compares the speed of the engine 14 to the noted stored engine speed, which in this example represents the known speed at which the engine 14 changes from the crank state to the run state. If the speed of the engine 14 has not reached the stored engine speed, the control circuit 36 continues to monitor the speed of the engine 14, at step 306. Once the speed of the engine 14 reaches the stored engine speed, the control circuit 36 assumes that the engine 14 has begun to run and, at step 310, the control circuit 36 identifies the position of the shift linkage 28, as communicated by the shift sensor 48 via the link 50. Thereafter, at step 312, the control circuit 36, based upon the position of the shift linkage 28 when the speed of the engine 14 reaches the stored engine speed, modifies the neutral state thresholds T1, T2, which determine when the control circuit 36 ceases to reduce the speed of the engine 14 to facilitate the shift change into Neutral Gear.

As mentioned herein above, in another example, the stored engine speed can represent a speed of the engine 14 that is known to occur upon a shift change from one of the forward and reverse gears into the neutral gear. That is, the present inventors have also recognized that when control lever 26 operates the transmission 22 to disconnect the propeller 20 from the engine 14, a sudden removal of load on the engine 14 occurs, which thereby causes a correspondingly sudden rise in speed (e.g. RPM) of the engine 14. Therefore according to this example, the control circuit 36 is programmed to assume that upon such a sudden rise in speed of the engine 14, the transmission 22 has transitioned from one of the forward or reverse gears to the neutral gear. On this basis, the control circuit 36 is programmed to adapt the noted neutral state thresholds T1, T2 according to the method described above.

More specifically, the control circuit 36 is programmed to compare the speed of the engine 14 to the stored engine speed and then modify, based upon the position of the shift linkage 28 when the speed of the engine 14 reaches the stored engine speed, the neutral state threshold T1, T2 that determines when the control circuit 36 reduces the speed of the engine 14 to facilitate a shift change. The control circuit 36 is programmed to make this modification by first determining whether the current neutral state threshold T1, T2 stored in the memory 40 varies by more than a predetermined amount from the position of the shift linkage 28 when the speed of the engine 14 reaches the stored engine speed. If yes, the control circuit 36 is programmed to adapt the neutral state thresholds T1, T2 by a certain calibrated amount, which can also be stored in the memory 40. If no, the control circuit 36 is programmed to not adapt the current neutral state thresholds T1, T2 stored in the memory 40.

The inventors have also recognized that the speed of the engine 14 may reach the noted stored engine speed for a variety of reasons, only one of which is that a shift has occurred from one of the forward and reverse gears to the neutral gear. For example, the speed of the engine 14 could significantly change based upon a trimming action of the marine propulsion device 12, an engagement between the propeller 20 and an obstruction, an addition of a heavy load to the marine vessel 11, removal of a load from the marine vessel 11, and/or the like. Therefore, to ensure that the threshold adaptation process is only employed when the shift has occurred, the control circuit 36 is programmed to disregard any occurrence of when the speed of the engine 14 reaches the stored engine speed if the shift linkage 28 position is not near the current thresholds T1 and T2 of the Neutral State 60, for example if the shift linkage 28 is not at a position that is within a predetermined amount or within a threshold relative to the currently known thresholds T1, T2. This allows the control circuit 36 to disregard situations where the change in speed is caused by a trimming action of the marine propulsion device 12, an engagement between the propeller 20 and an obstruction, an addition of a heavy load to the marine vessel 11, etc., because each of these instances are unlikely to occur at the same time as a movement of the control lever 26 near the Neutral State 60. That is, the present inventors have realized that if the control lever is located near to the thresholds T1, T2, it is likely that the change in speed of the engine 14 is because of an actual shift event.

Figure 10:
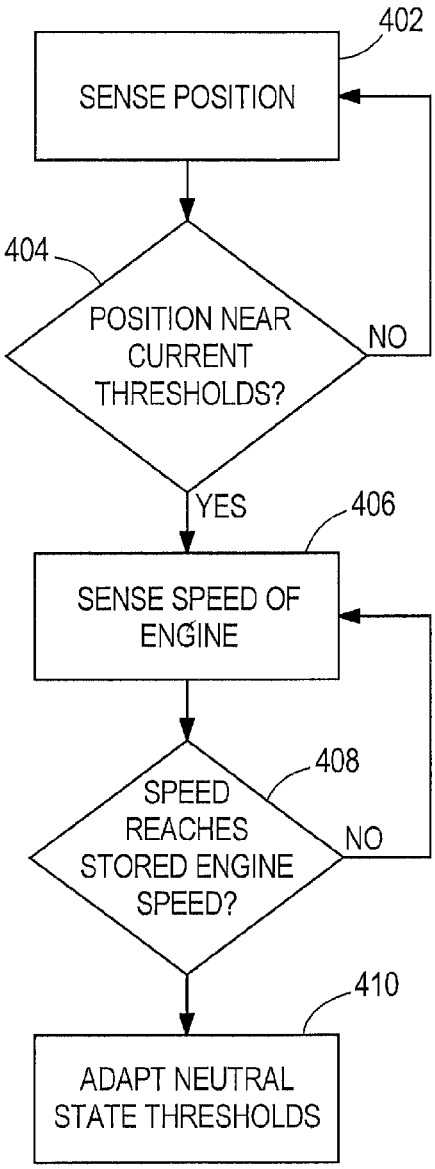
FIG. 10 is another flow chart depicting steps in another example of a method for facilitating shift changes in marine propulsion devices.

FIG. 10 depicts one example of a method according to this embodiment. At step 402, the position of the shift linkage 28 is sensed by the shift position sensor 48 and then communicated to the control circuit 36. At step 404, the control circuit 36 determines whether the shift linkage 28 is near the current thresholds T1 and T2. If no, the method returns to step 402. If yes, the position sensor 48 senses and communicates the speed of the engine 14 to the control circuit 36 via the link 33. Thereafter, at step 408, the control circuit 36 determines whether the sensed speed of the engine 14 has reached a stored engine speed that represents a known speed that occurs upon a shift change from one of the forward and reverse gears into the neutral gear. If no, the method returns to step 406. If yes, at step 410, the control circuit 36 adapts the neutral state thresholds T1, T2 by a calibrated or predetermined amount, as described herein above.

In another example, the control circuit 36 is programmed to disregard an occurrence of when the speed of the engine 14 reaches the stored engine speed if the shift linkage 28 is not at a position that is within a predetermined amount or within a threshold relative to the currently known thresholds T1, T2 of the Neutral State 60 and further where the control lever 26 has changed position at or above a certain stored rate, which can be stored in the memory 40.

Figure 11:
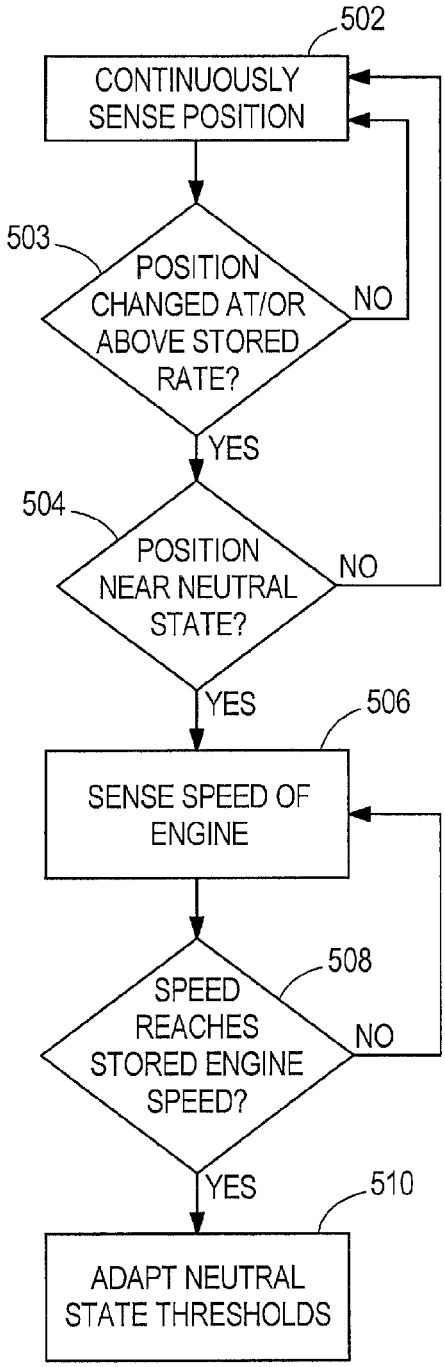
FIG. 11 is another flow chart depicting steps in another example of a method for facilitating shift changes in marine propulsion devices.

FIG. 11 depicts another example of a method according to this embodiment. At step 502, the position of the shift linkage 28 is continuously sensed by the shift position sensor 48 and communicated to the control circuit 36. At step 503, the control circuit 36 determines whether the position of the shift linkage 28 has changed at or above a stored rate that is stored in the memory 40. If no, the method continues at step 503. If yes, at step 504, the control circuit compares the current position of the shift linkage 28 to the Neutral State thresholds T1, T2 and determines whether the shift linkage 28 is within a predetermined distance or within a threshold relative to the currently known thresholds T1, T2. The predetermined distance can be stored in the memory 40. If no, the method returns to step 502. If yes, at step 506, the position sensor 48 senses and communicates the speed of the engine to the control circuit 36 via the link. Thereafter, at step 508, the control circuit 36 determines whether the sensed speed of the engine 14 has reached a stored engine speed that represents a known speed that occurs upon a shift change from one of the forward and reverse gears into the neutral gear. If no, the method returns to step 506. If yes, at step 510, the control circuit adapts the Neutral State thresholds T1, T2 by a calibrated or predetermined amount, as described herein above.

It will thus be understood that the present disclosure provides a system 10*a* for facilitating shift changes in marine propulsion devices 12. The system 10*a* can include an internal combustion engine 14; a shift linkage 28 that operatively connects a control lever 26 to a transmission 22 for effecting shift changes amongst a reverse gear, a neutral gear and a forward gear; a shift position sensor 48 that senses position of the shift linkage 28; and an engine speed sensor 31 that senses speed of the engine 14. The control circuit 36 is programmed to compare the speed of the engine 14 to a stored engine speed, which can represent a known speed at which the engine 14 changes from a crank state in which the engine 14 is cranking to a run state in which the engine 14 is running. The control circuit 36 is configured to modify, based upon the position of the shift linkage 28 when the speed of the engine 14 reaches the stored engine speed, a neutral state threshold (e.g. T1, T2) that determines when the control circuit 36 ceases to reduce the speed of the engine 14 to facilitate the shift change. The control circuit 36 is programmed to identify the position of the shift linkage 28 when the speed of the engine 14 reaches the stored engine speed and then add positive and negative calibrated amounts to thereby identify the upper neutral state threshold T1 and the lower neutral state threshold T2, respectively. In this manner, when a shift change is ultimately made from forward gear to neutral gear, the upper neutral state threshold T1 designates a threshold of the Forward-to-Neutral State 68 at which the control circuit 36 stops reducing the speed of the engine 14 to facilitate the shift change. When the shift change is ultimately made from the reverse gear to the neutral gear, the lower neutral state threshold T2 designates a threshold of the Reverse-to-Neutral State 72 at which the control circuit 36 stops reducing the speed of the engine 14 to facilitate the shift change. In other words, once the upper and lower neutral state thresholds T1, T2 are adapted, the control circuit 36 can continue to sense the position of the shift linkage 28 after the shift linkage 28 reaches the neutral state threshold T1, T2 and thereafter the control circuit 36 ceases control of speed of the engine 14 when the shift linkage 28 returns to the neutral state threshold T1, T2.

Therefore it will also be understood that the present disclosure provides a method of facilitating shift changes in the marine propulsion device 12. The method can include sensing a position of the shift linkage (step 304), sensing a speed of the engine 14 (step 306), comparing the speed of the engine 14 to a stored engine speed (step 308) and modifying, based upon the position of the shift linkage 28 when the speed of the engine 14 reaches the stored engine speed, a neutral state threshold T1, T2 that determines when the speed of the engine 14 is no longer reduced to facilitate a shift change (step 312). Optionally, the method can include the steps of continuing to sense the position of the shift linkage 28 after the shift linkage 28 reaches the neutral state threshold T1, T2 and thereafter ceasing control of the speed of the engine 14 when the shift linkage 28 returns to the neutral state threshold T1, T2.

Therefore it will also be understood that the present disclosure provides a method of facilitating shift changes in the marine propulsion device 12 that includes sensing the position of the shift linkage (step 402) determining whether the shift linkage is near the Neutral State 60 (step 404), sensing the speed of the engine 14 (step 406), comparing the speed of the engine 14 to a stored engine speed (408) and modifying, based upon the position of the shift linkage 28 when the speed of the engine 14 reaches the stored engine speed, a neutral state threshold T1, T2 that determines when the speed of the engine 14 is no longer reduced to facilitate a shift change (step 410). In other examples, the method can include the step of disregarding an occurrence of when the speed of the engine 14 reaches the stored engine speed if the shift linkage 28 does not have a position that is near to the current thresholds T1, T2 and/or if the position of the shift linkage 28 has not changed by more than a stored rate (steps 503, 504).

Certain examples disclosed herein thus provide for quicker adaptation of the thresholds T1, T2 of the Neutral State 60, for example at startup and crank of the engine 14. Certain examples also allow for other thresholds in the control state flow to be adapted for more accurate shift cable adjustment diagnostics. Certain examples allow for a reduction in the size of the Neutral State 60, thus allowing for continued shift interrupt strategies to assist the operator to achieve neutral from gear. Certain examples provide the operator with the ability to begin and terminate shift interrupt strategies on a mechanical engine more accurately to increase the efficacy of the shift strategies while eliminating the inherent variability between engines/gear cases/adjustments.

What is claimed is:

1. A method of facilitating shift changes in a marine propulsion device, the marine propulsion device having an internal combustion engine and a shift linkage that operatively connects a shift control lever to a transmission for effecting the shift changes amongst a reverse gear, a neutral gear and a forward gear, the method comprising:

sensing a position of the shift linkage;

sensing a speed of the engine;

comparing the speed of the engine to a stored engine speed; and modifying, based upon the position of the shift linkage when the speed of the engine reaches the stored engine speed, a neutral state threshold that determines when the speed of the engine is no longer reduced to facilitate a shift change.

2. The method according to claim 1, wherein the stored engine speed is a known speed at which the engine changes from a crank state in which the engine is cranking to a run state in which the engine is running.

3. The method according to claim 2, comprising identifying the position of the shift linkage when the speed of the engine reaches the stored engine speed and adding positive and negative calibrated amounts to identify a lower neutral state threshold and an upper neutral state threshold, respectively.

4. The method according to claim 3, wherein the shift change is from the forward gear to the neutral gear and wherein the upper neutral state threshold also designates a threshold of a forward-to-neutral state in which the speed of the engine is no longer reduced to facilitate the shift change.

5. The method according to claim 3, wherein the shift change is from the reverse gear to the neutral gear and wherein the lower neutral state threshold designates a threshold of a reverse-to-neutral state in which the speed of the engine is no longer reduced to facilitate the shift change.

6. The method according to claim 1, comprising sensing the position of the shift linkage with a potentiometer that outputs analog-to-digital counts (ADC) to a control circuit.

7. The method according to claim 1, comprising continuing to sense the position of the shift linkage after the shift linkage reaches the neutral state threshold and thereafter ceasing to reduce speed of the engine when the shift linkage returns to the neutral state threshold.

8. The method according to claim 1, wherein the stored engine speed is a known speed that occurs upon a shift change from one of the forward and reverse gears to the neutral gear.

9. The method according to claim 8, comprising disregarding an occurrence of when the speed of the engine reaches the stored engine speed if the shift linkage position is not near the current thresholds.

10. The method according to claim 8, comprising disregarding an occurrence of when the speed of the engine reaches the stored engine speed the shift linkage has not changed position by more than a stored rate.

11. A system for facilitating shift changes in a marine propulsion device, the system comprising:

an internal combustion engine;

a shift linkage that operatively connects a shift control lever to a transmission for effecting shift changes amongst a reverse gear, a neutral gear and a forward gear;

a position sensor that senses position of the shift linkage;

a speed sensor that senses speed of the engine; and a control circuit that compares the speed of the engine to a stored engine speed;

wherein the control circuit modifies, based upon the position of the shift linkage when the speed of the engine reaches the stored engine speed, a neutral state threshold that determines when the control circuit ceases reducing the speed of the engine to facilitate a shift change.

12. The system according to claim 11, wherein the stored engine speed is a known speed at which the engine changes from a crank state in which the engine is cranking to a run state in which the engine is running.

13. The system according to claim 12, wherein the control circuit identifies the position of the shift linkage when the speed of the engine reaches the stored engine speed and adding positive and negative calibrated amounts to identify an upper neutral state threshold and a lower neutral state threshold, respectively.

14. The system according to claim 13, wherein the shift change is from the forward gear to the neutral gear and wherein the upper neutral state threshold also designates a threshold of a forward-to-neutral state in which the control circuit ceases reducing the speed of the engine to facilitate the shift change.

15. The system according to claim 13, wherein the shift change is from the reverse gear to the neutral gear and wherein the lower neutral state threshold also designates a threshold of a reverse-to-neutral state in which the control circuit ceases reducing the speed of the engine to facilitate the shift change.

16. The system according to claim 11, wherein the position sensor comprises a potentiometer that outputs analog-to-digital counts (ADC) to the control circuit.

17. The system according to claim 11, wherein the control circuit continues to sense the position of the shift linkage after the shift linkage reaches the neutral state threshold and thereafter the control circuit ceases to reduce speed of the engine when the shift linkage returns to the neutral state threshold.

18. The system according to claim 11, wherein the stored engine speed is a known speed that occurs upon a shift change from one of the forward and reverse gears to the neutral gear.

19. The system according to claim 18, wherein the control circuit disregards an occurrence of when the speed of the engine reaches the stored engine speed if the shift linkage position is not near the current thresholds.

20. The system according to claim 18, wherein the control circuit disregards an occurrence of when the speed of the engine reaches the stored engine speed if the shift linkage has not changed position by more than a stored rate.

* * * * *